US005390435A

United States Patent [19]

Grody

[11] Patent Number: 5,390,435

[45] Date of Patent: Feb. 21, 1995

[54] POINT OF SALE DISPLAY FOR HOLDING A BRANDSIGN

[75] Inventor: Allan D. Grody, West Hartford, Conn.

[73] Assignee: Gastro-Gnomes, Inc., West Hartford, Conn.

[21] Appl. No.: 142,689

[22] Filed: Oct. 26, 1993

[51] Int. Cl.[6] ..... G09F 3/16; G09F 3/20

[52] U.S. Cl. ..... 40/310; 40/658; 40/630

[58] Field of Search ..... 40/310, 658, 642, 630, 40/638, 666, 594

[56] References Cited

U.S. PATENT DOCUMENTS

| | | | |
|---|---|---|---|
| 2,566,837 | 9/1951 | Huelsmeyer | 40/658 |
| 3,149,431 | 4/1964 | Blish | 40/310 |
| 4,051,615 | 10/1977 | Gosanko et al. . | |
| 4,745,695 | 5/1988 | Hetzer . | |
| 4,856,214 | 8/1989 | Machen . | |
| 5,044,104 | 9/1991 | Hopperdietzel . | |
| 5,161,767 | 11/1992 | Hansen . | |

FOREIGN PATENT DOCUMENTS

| | | | |
|---|---|---|---|
| 0488813 | 6/1992 | European Pat. Off. | 40/638 |
| 0565418 | 10/1993 | European Pat. Off. | 40/310 |
| 1360299 | 3/1964 | France | 40/310 |
| 3513234 | 10/1986 | Germany | 40/642 |
| 3900904 | 2/1990 | Germany . | |
| 2225893 | 6/1990 | United Kingdom . | |

*Primary Examiner*—Edward K. Look
*Assistant Examiner*—Christopher Verdier
*Attorney, Agent, or Firm*—Ware, Fressola, Van der Sluys & Adolphson

[57] ABSTRACT

The invention features a point of sale display for holding a brandsign. A first member (12) thereof has first and second planar portions (**12*a*, 12*c*), a non-planar portion (12*b*) arranged between the first and second planar portions (12*a*, 12*c*), a terminating edge (12*d*) on one end of the second planar portion (12*c*), and an inner contacting surface (12*e*) extending along the first and second planar portion (12*a*, 12*c*) and the non-planar portion (12*b*). A second member (14) thereof has a first and second planar portion (14*a*, 14*c*), a non-planar portion (14*b*) arranged between the first and second planar portions (14*a*, 14*c*), a terminating edge (12*d*) on one end of the second planar portion (14*c*), and an inner contacting surface (14*e*) extending along the first and second planar portions (14*a*, 14*c*) and the non-planar portion (14*b*). A flexible part (16) flexibly connects the first and second members (12, 14) for defining a holding space (18) between the inner contacting surfaces (12*e*, 14*e*) of the first and second members (12, 14). A part of the inner contacting surface (14*e*) of the non-planar portion (14*b*) resiliently contacts a part of the inner contacting surface (12*e*) along the second planar portion (12*c*) to define a pinch zone (20) for retaining the brandsign (100) in the holding space (18). The terminating edge (14*d*) extends outwardly and flares divergently away from the terminating edge (12*d*) to define an entry zone (30) for receiving the brandsign (100) and thereby facilitating entry of the brandsign (100) into the pinch zone (30**).

13 Claims, 3 Drawing Sheets

FIG. 1
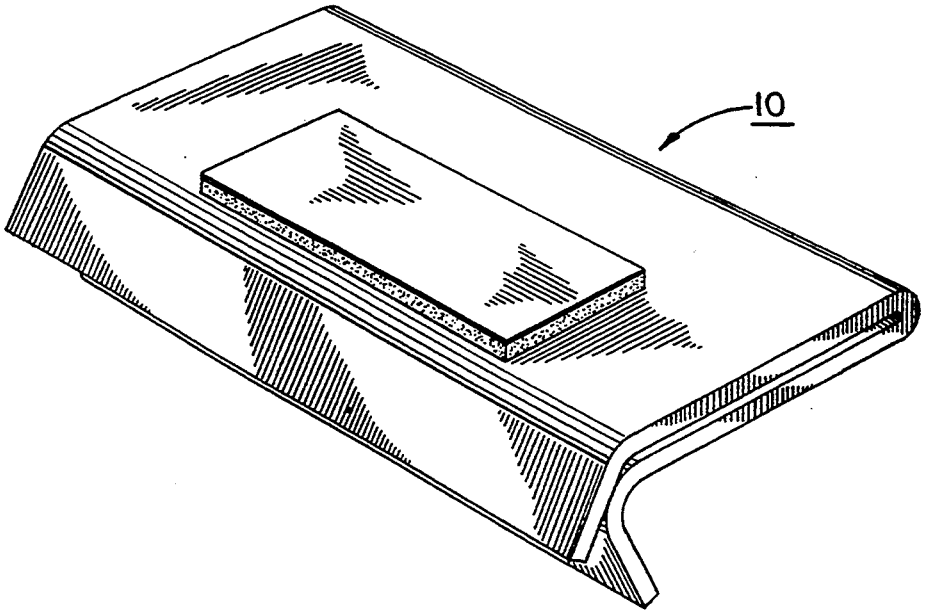
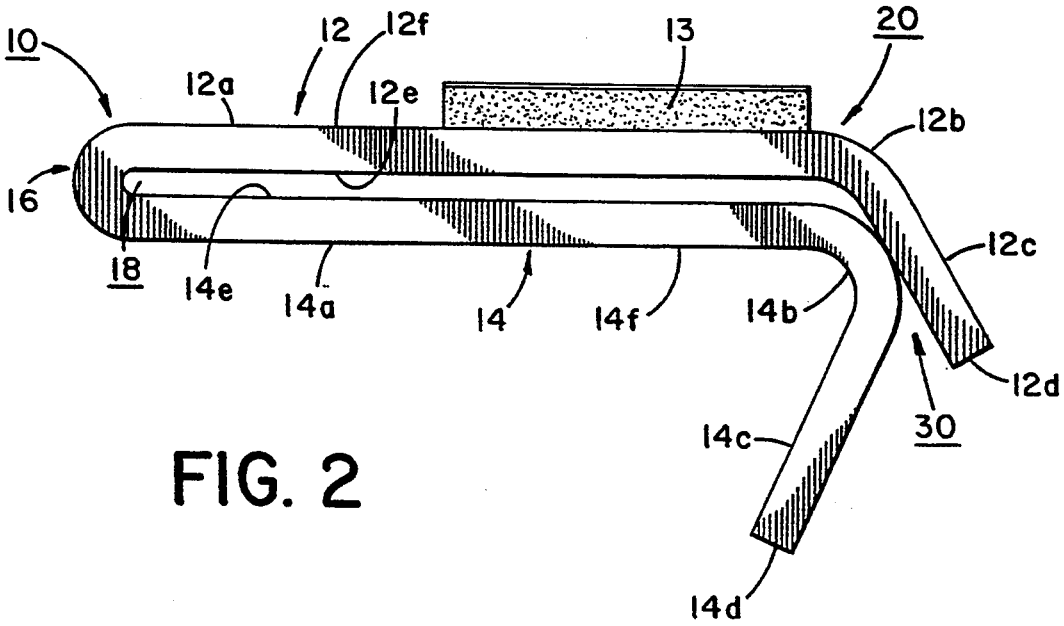
FIG. 2

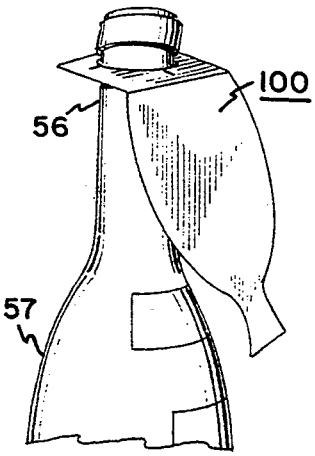
FIG. 3A
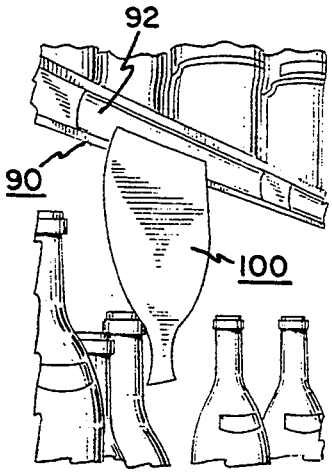
FIG. 3G
FIG. 3C
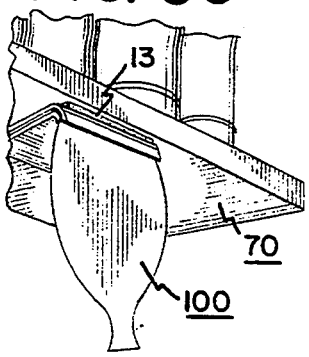
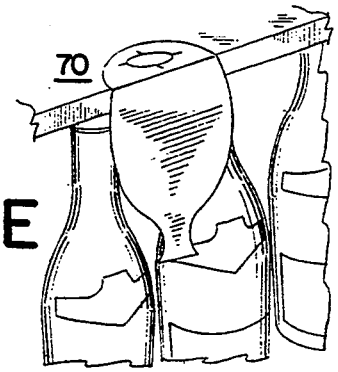
FIG. 3E
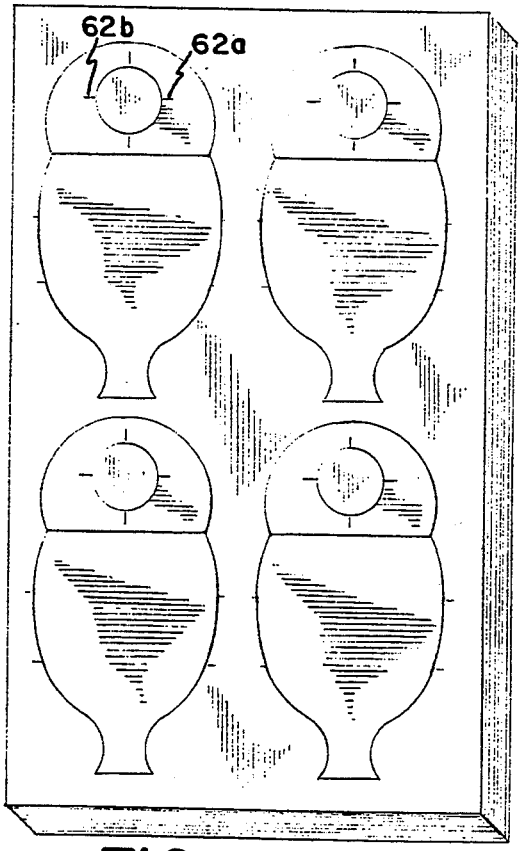
FIG. 3B
FIG. 3F
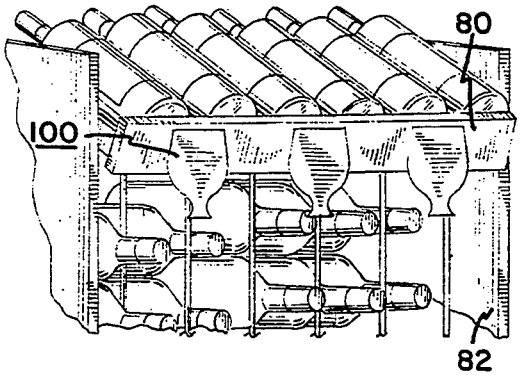
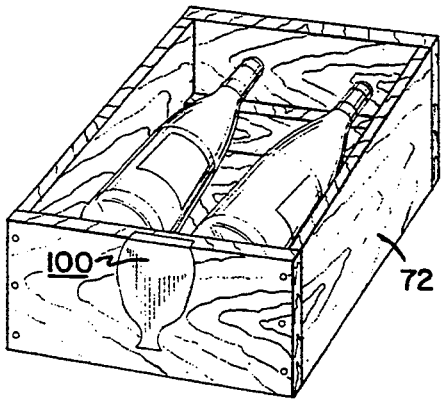
FIG. 3D

POINT OF SALE DISPLAY FOR HOLDING A BRANDSIGN

BACKGROUND OF THE INVENTION

1. Field of the Invention

The present invention generally relates to a point of sale display, and more particularly to a point of sale display for holding a brandsign.

2. Description of the Prior Art

There are many known display devices, including the following:

U.S. Pat. No. 4,745,695, issued to Hetzen, discloses an information carrier holder 10 for receiving information signs or tags about goods on a store rack. The holder as illustrated in FIGS. 1 and 2 is made from a transparent plastic folded to form front and rear walls 12 and 18. An adhesive layer 24 is included to attach the holder 30 to a rack 38. A hook 14 is provided on the front wall and projection 20 on the upper end of the rear wall.

U.S. Pat. No. 4,856,214, issued to Machen, shows an information folder for attachment to a telephone cord. It is formed of clear plastic with pockets 10 and VELCRO TM buttons 18 that hold the device on a cord when folded as shown in FIG. 3. See also FIG. 1.

U.S. Pat. No. 5,044,104, issued to Hopperdietzel, discloses a label carrier 1 which has a pocket 5 formed by front and rear walls 11 and 12. See FIGS. 1*a*–1*c*. The carrier is attached to a mold strip 2 on a shelf 3, column 3, lines 1–28.

U.S. Pat. No. 5,161,767, issued to Hansen, discloses a copy holder 1 that is attached to the side of a display screen device. See FIG. 4. FIGS. 1 and 2 show the use of VELCRO TM strips 4 and 4A–4D that are used to attach the bend copy holder to the side of the display screen device.

British patent 2,225,893, issued to Stovald, discloses a display holder device formed of clear plastic and folded to the designs illustrated in FIGS. 3, 5 and 6. FIG. 3 shows VELCRO TM pads 17 that are used to attach the holder to a surface carrying material to which the display pertains.

U.S. Pat. No. 4,051,615, issued to Gosanko et al, discloses a display device 1 formed of clear plastic and folded to provide front and rear panels 2 and 3 as illustrated in FIGS. 1 and 3. The display device 1 is designed to hold a newspaper on a wire rack 12. The front and rear panels have transversely bent lip portions 4 and 13.

German patent 3,900,094, issued to Stuff, shows a label holder having a pocket 16 between front cover 14 and rear wall 12. The upper portion of cover 14 and wall 12 are bent outwardly as illustrated at 38 in FIGS. 1 and 2. The label holder is attached to shelf 24 and is adjustable to the two angular positions shown in FIGS. 1 and 2.

SUMMARY OF THE INVENTION

The invention features a point of sale device for holding a brandsign, which includes a first member having a first generally planar portion, a second generally planar portion, and a non-planar portion arranged between the first generally planar portion and the second generally planar portion. The second generally planar portion has a terminating edge on one end thereof. The first member has an inner contacting surface extending along the first and second generally planar portion and the non-planar portion of the first member.

The point of sale device also has a second member which includes a first generally planar portion, a second generally planar portion, and a non-planar portion arranged between the first generally planar portion and the second generally planar portion. The second generally planar portion has a terminating edge on one end thereof. The second member has an inner contacting surface extending along the first and second generally planar portions and the generally non-planar portion of the second member.

The point of sale device also has means for flexibly connecting the first member and second member for defining a holding space between opposing inner surfaces, respectively of the first and second members. A part of the inner surface of the second member resiliently contacts a part of the inner surface of the first member before either of their respective terminating edges to define a pinch zone for retaining the brandsign in the holding space.

The terminating edge of the first member extends outwardly and flares divergently away from the terminating edge of the second member to define an entry zone for receiving the brandsign and thereby facilitating entry of the brandsign into the pinch zone.

An advantage of the invention is to provide an advertising device which is easy to use as an advertising device, versatile in the manner in which it can be used and inexpensive to manufacture.

Other objects of the invention will in part be obvious and will in part appear hereinafter.

The invention accordingly comprises the features of construction, combination of elements, and arrangements of parts which will be exemplified in the construction herein after set forth, and the scope of the invention will be indicated in the claims.

BRIEF DESCRIPTION OF THE DRAWINGS

For a fuller understanding of the nature and object of the invention, references should be made to the following detailed description taken in connection with the accompanying drawing, in which:

FIG. 1 is a perspective view of the point of the sale display device;

FIGS. 2(*a*) and 2(*b*) show a front and back view of a brandsign;

FIGS. 3(*a*) and 3(*c*) through 3(*g*) show the point of sale display and the brandsign in various display configuration modes; and FIG. 3(*b*) shows the brandsign prescored on a heavy weight sheet of paper.

DETAILED DESCRIPTION OF THE PREFERRED EMBODIMENTS

Figure 2B:
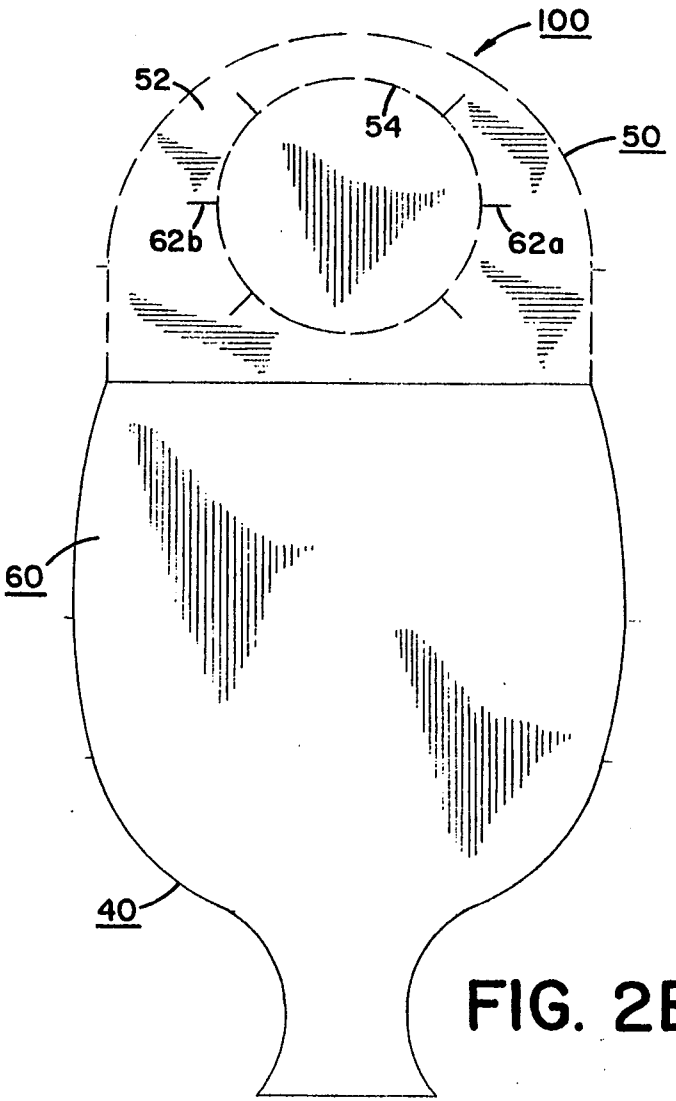
FIG. 2 shows a side view of the point of sale display device shown on FIG. 1(*a*)
Figure 2A:
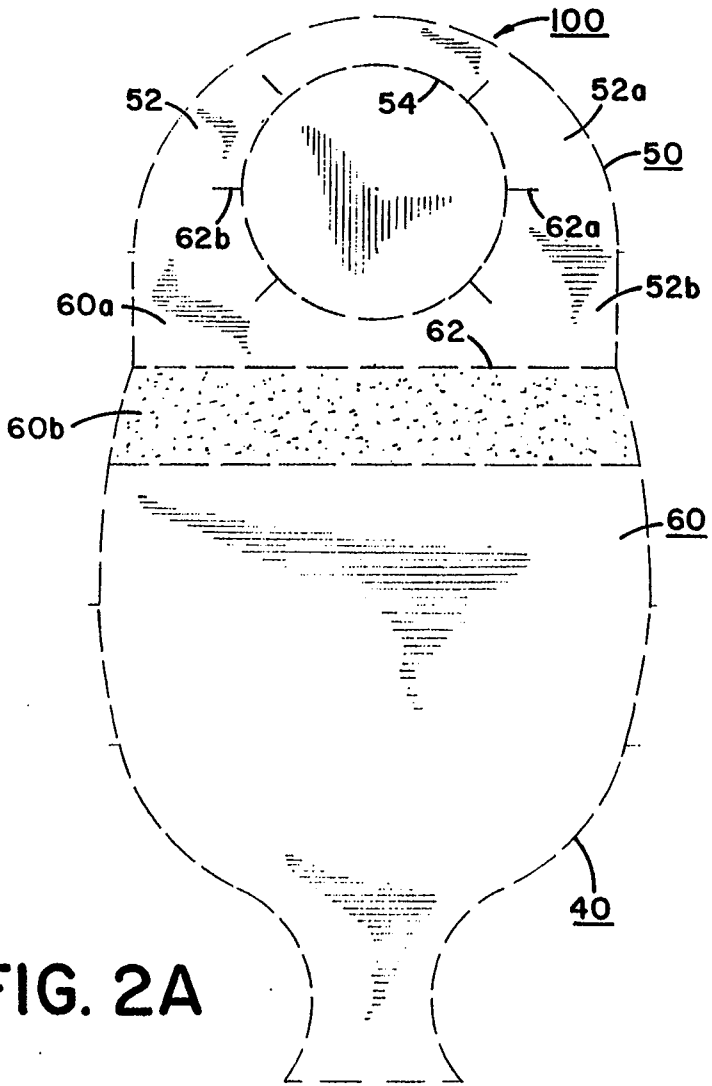

As shown in FIGS. 1 and 2, the invention features a point of sale device 10 for holding a brandsign 100 (FIG. 2), which includes a first member 12 having a first generally planar portion 12*a*, a second generally planar portion 12*c*, and a generally non-planar portion 12*b* arranged between the first generally planar portion 12*a* and the second generally planar portion 12*c*. The second generally planar portion 12*c* has a terminating edge 12*d* on one end thereof. The first member 12 also has an inner contacting surface 12*e* extending along the first and second generally planar portions 12*a*, 12*c* and the generally non-planar portion 12*b* of the first member 12.

The point of sale device 10 has a second member 14 which includes a first generally planar portion 14*a*, a second generally planar portion 14*c*, and a non-planar portion 14*b* arranged between the first generally planar portion 14*a* and the second generally planar portion 14*c*. The second generally planar portion 14*c* has a terminating edge 14*d* on one end thereof. The second member 14 also has an inner contacting surface 14*e* extending along the first and second generally planar portions 14*a*, 14*c* and the generally non-planar portion 14*b* of the second member 14.

The point of sale device 10 has means for flexibly connecting 16 the first member 12 and the second member 14 for defining a holding space 18 between opposing inner contacting surfaces 12*e*, 14*e* respectively of the first and second members 12, 14. A part of the inner contacting surface 12*e* of the first member 12 resiliently contacts a part of the inner contacting surface 14*e* of the second member 14 before either of their respective terminating edge 12*d*, 14*d* to define a pinch zone 20 for retaining the brandsign 100 in the holding space 18, as best shown in FIG. 3(*a*).

The terminating edge 12*d* of the first member 12 and the terminating edge 14*d* of the second member 14 extend outwardly from the pinch zone 20. The second generally planar portion 12*c* and the second generally planar portion 14*c* flare divergently away from each other, as shown, to define an entry zone 30 for receiving the brandsign 100 and making it easy to guide the brandsign 100 into the pinch zone 20.

As shown in FIGS. 1 and 2, a part of the inner contacting surface 14*e* of the non-planar portion 14*b* of the second member 14 resiliently contacts a part of the inner surface 12*c* along the second generally planar portion 12*c* of the first member 12.

The non-planar portions 12*b*, 14*b* of the first and second members 12, 14 are shaped as an arc. As shown, the arc of the non-planar portion 12*b* of the first member 12 is bowed less than the arc of the non-planar portion 14*b* of the second member 14 so respective terminating edges 12*d*, 14*d* of the first and second members 12, 14 flare divergently away from each other. The second generally planar portion 12*c* of the first member 12 has a shorter length than the second generally planar portion 14*c* of the second member 14.

The point of sale display device is preferably made of plastic and is an integral unit; however, other flexible materials can also be used.

The first member 12 has a back surface 12*f* with means 13 such as a double-side adhesive strip for adhesively contacting another surface as best shown in FIG. 3(*c*). In the alternative a velcro strip could be adhesively affixed to the back surface 12*f* of the point of sale device, for being releasably affixed to a corresponding velcro strip on a display shelf.

As shown in FIGS. 2(*a*) and 2(*b*), the brandsign 100 includes means for displaying 40 and means for attaching 50 the brandsign 100. The brandsign 100 also includes an adhesive backing 60 with perforations 62 for peeling off to affix the brandsign 100 to be displayed. The means for attaching 50 includes a folding flap 52 having a bottle necker 54 arranged therein for hanging the brandsign 100 over a neck 56 of a bottle 57, as shown in FIG. 3(*a*). As shown in FIG. 2(*a*), the means for attaching 50 is foldable along perforations 62*a* and 62*b* for sliding into the entry zone 20 of the point of sale display 10 shown in FIG. 1 and FIG. 3(*c*).

FIG. 3(*a*) shows the brandsign 100 with the bottle necker 54 arranged on the neck 56 of a bottle 57.

FIG. 3(*b*) shows a sheet of brandsigns 100 having perforations 62*a* and 62*b*.

FIG. 3(*c*) shows the point of sale device 10 adhesively affixed on a shelf 70. As shown, the brandsign 100 is arranged in the point of sale device 10.

FIG. 3(*d*) shows the brandsign 100 adhesively affixed on a case of wine 72. In order to affix the brandsign 100 in this manner, it is cut along perforations 62*a* and 62*b* to eliminate the top part 52*a* of the folding flap 52 as show in FIG. 2. Then the bottom part of the adhesive backing 60*a* is stripped off and affixed to the wine case 72, as shown in FIG. 3(*d*).

FIG. 3(*e*) shows a brandsign 100 affixed on a top of a shelf 70. In order to affix the brandsign 100 in this manner, the adhesive backing 60*a* is stripped off and affixed on the top of the shelf 70.

FIG. 3(*f*) shows the brandsign 100 affixed on a front facia board 80 of a wine rack 82. In order to affix the brandsign 100 in this manner, the folding flap 52 is cut off as shown in FIG. 2. Then an intermediate part 60*b* of the adhesive backing 60 is peeled off, and the brandsign 100 affixed to the facia board 80 of the wine rack, as shown in FIG. 3(*f*).

FIG. 3(*g*) shows a brandsign 100 affixed to a front face 92 of a shelf 90. The brandsign 100 is affixed in a manner similar to the brandsign 100 shown in FIG. 3(*f*).

The aforementioned embodiments admirably achieve the objects of the invention; however, it will be appreciated that other arrangements and configurations can be made by those skilled in the art without departing from the spirit and scope of the invention which is deemed limited only by the appended claims and the reasonable interpretation thereof.

What is claimed is:

1. A brandsign (100) capable of use with a point of sale display of the type including a first member (12) having a first generally planar portion (12*a*), a second generally planar portion (12*c*) a non-planar portion (12*b*) arranged between the first generally planar portion (12*a*) and the second generally planar portion (12*c*), a terminating edge (12*d*) on one end of the second generally planar portion (12*c*), and an inner contacting surface (12*e*) extending along the first and second generally planar portions (12*a*, 12*c*) and the non-planar portion (12*b*) of the first member (12);

a second member (14) having a first generally planar portion (14*a*), a second generally planar portion non-planar portion (14*b*) arranged between the first generally planar portion (14*a*) and the second generally planar portion (14*c*), a terminating edge (14*d*) on one end of the second generally planar portion (14*b*), and an inner contacting surface (14*e*) extending along the first and second generally planar portions (14*a*, 14*c*) and the generally non-planar portion (14*b*) of the second member (14);

means (16) for flexibly connecting the first member (12) and second member (14) for defining a holding space (18) between said inner contacting surfaces (12*e*, 14*e*) of the first and second members (12, 14);

a part of the inner contacting surface (14*e*) of the second member (14) along the non-planar portion (14*b*) resiliently contacting a part of the inner contacting surface (12*e*) of the first member (12) along the second generally planar portion (14*c*) to define a pinch zone (20) for retaining the brandsign (100) in the holding space (18); and the terminating edge (14*d*) of the second member (14) extending outwardly and flaring divergently away from the terminating edge (12*d*) of the first member (12) to define an entry zone for receiving the brandsign (100) and thereby facilitating entry of the brandsign (100) into the pinch zone (20);

means (40) for displaying a brandname of a product; and means (50) for selectively attaching the means (40) for displaying, having a bottle necker (54) perforated therein for removing to hang the brandsign (100) on a neck (56) of a bottle (57), having a fold perforated therein for bending and inserting in the entry zone of the point of sale display, and having an adhesive backing (13) and a protective sheet over the adhesive backing (13), the protective sheet having perforations positioned along a portion thereof for peeling off a portion of the protective sheet, thereby exposing the adhesive backing (13) so as to affix the brandsign (100) to an external object.

2. A point of sale display for holding a brandsign comprising:

a first member (12) having a first generally planar portion (12*a*), a second generally planar portion (12*c*), a non-planar portion (12*b*) arranged between the first generally planar portion (12*a*) and the second generally planar portion (12*c*), a terminating edge (12*d*) on one end of the second generally planar portion (12*c*), and an inner contacting surface (12*e*) extending along the first and second generally planar portions (12*a*, 12*c*) and the non-planar portion (12*b*) of the first member (12);

a second member (14) having a first generally planar portion (14*a*), a second generally planar portion (14*c*), a generally non-planar portion (14*b*) arranged between the first generally planar portion (14*a*) and the second generally planar portion (14*c*), a terminating edge (12*d*) on one end of the second generally planar portion (14*c*), and an inner contacting surface (14*e*) extending along the first and second generally planar portions (14*a*, 14*c*) and the generally non-planar portion (14*b*) of the second member (14);

means (16) for flexibly connecting the first member (12) and second member (14) for defining a holding space (18) between said inner contacting surfaces (12*e*, 14*e*) of the first and second members (12, 14);

a part of the inner contacting surface (14*e*) of the non-planar portion (14*b*) along the second member (14) resiliently contacting a part of the inner contacting surface (12*e*) along the second generally planar portion (12*c*) of the first member (12) to define a pinch zone (20) for retaining the brandsign (100) in the holding space (18); and the terminating edge (14*d*) of the second member (14) extending outwardly and flaring divergently away from the terminating edge (12*d*) of the first member (12) to define an entry zone (30) for receiving the brandsign (100) and thereby facilitating entry of the brandsign (100) into the pinch zone (30).

3. An apparatus according to claim 2, wherein said first, second, third and fourth members (12, 12*a*, 12*b*, 12*c*, 14, 14*a*, 14*b*, 14*c*) and said means (16) for flexibly connecting are integrally fabricated from plastic.

4. An apparatus according to claim 2, wherein said first member has a back surface (12*f*) with means (13) for adhesively contacting the apparatus to another surface.

5. A point of sale display according to claim 2, wherein the non-planar portion (12*b*) of the first member (12) is arcuately shaped.

6. A point of sale display according to claim 5, wherein the non-planar portion (14*b*) of the second member (14) is arcuately shaped.

7. A point of sale display according to claim 6, wherein the arc of the non-planar portion (12*b*) of the first member (12) is bowed less than the arc of the non-planar portion (14*b*) of the second member (14).

8. A point of sale display according to claim 5, wherein the second generally planar portion (12*a*) of the first member (12) has a substantially shorter length than the second generally planar portion (14*c*) of the second member (14).

9. A point of sale display, comprising:

a brandsign (100);

a first member (12) having a first generally planar portion (12*a*), a second generally planar portion (12*c*), a non-planar portion (12*b*) arranged between the first generally planar portion (12*a*) and the second generally planar portion (12*c*), a terminating edge (12*d*) on one end of the second generally planar portion (12*c*), and an inner contacting surface (12*e*) extending along the first and second generally planar portions (12*a*, 12*c*) and the non-planar portion (12*b*) of the first member (12);

a second member (14) having a first generally planar portion (14*a*), a second generally planar portion, a non-planar portion (14*b*) arranged between the first generally planar portion (14*a*) and the second generally planar portion (14*c*), a terminating edge (14*d*) on one end of the second generally planar portion (14*b*), and an inner contacting surface (14*e*) extending along the first and second generally planar portions (14*a*, 14*c*) and the generally non-planar portion (14*b*) of the second member (14);

means (16) for flexibly connecting the first member (12) and second member (14) for defining a holding space (18) between said inner contacting surfaces (12*e*, 14*e*) of the first and second members (12, 14);

a part of the inner contacting surface (14*e*) of the second member (14) along the non-planar portion (14*b*) resiliently contacting a part of the inner contacting surface (12*e*) of the first member (12) along the second generally planar portion (14*c*) to define a pinch zone (20) for retaining the brandsign (100) in the holding space (18); and the terminating edge (14*d*) of the second member (14) extending outwardly and flaring divergently away from the terminating edge (12*d*) of the first member (12) to define an entry zone for receiving the brandsign (100) and thereby facilitating entry of the brandsign (100) into the pinch zone (20).

10. A point of sale display according to claim 9, wherein the brandsign (100) includes means (40) for displaying a brandname of a product; and means (50) for attaching the brandsign (100) to be displayed.

11. A point of sale display according to claim 10, wherein the brandsign (100) includes an adhesive backing and a protective sheet over the adhesive backing (60), the protective sheet having perforations (62*a*, 62*b*) positioned along a portion thereof for peeling off a portion of the protective sheet, thereby exposing the adhesive backing (13) so as to affix the brandsign (100) to an external object.

12. A point of sale display according to claim 10, wherein the means (50) for attaching includes a folding flap (52) having a bottle necker (54) arranged therein for hanging the brandsign (100) over a neck (56) of a bottle (57).

13. A point of sale display according to claim 12, wherein the means (50) for attaching is foldable.

* * * * *

UNITED STATES PATENT AND TRADEMARK OFFICE

CERTIFICATE OF CORRECTION

PATENT NO. : 5,390,435

DATED : February 21, 1995

INVENTOR(S) : Allan D. Grody

It is certified that error appears in the above-indentified patent and that said Letters Patent is hereby corrected as shown below:

At column 4, line 41 (claim 1, line 5), please insert a comma after "(12c)".

At column 5, prior to line 9, please insert a new line as follows: --the brandsign comprising, in combination:--.

At column 6, line 14 (claim 8, line 2), please change "(12a)" to --(12c)--.

Signed and Sealed this

Twelfth Day of September, 1995

*Attest:*

Bruce Lehman

BRUCE LEHMAN

*Attesting Officer*

*Commissioner of Patents and Trademarks*